US011655588B2

(12) United States Patent
Saetheråsen et al.

(10) Patent No.: US 11,655,588 B2
(45) Date of Patent: May 23, 2023

(54) SYSTEM AND CHIP CHUTE FOR FEEDING COMMINUTED CELLULOSIC MATERIAL

(71) Applicant: VALMET AB, Sundsvall (SE)

(72) Inventors: Jonas Saetheråsen, Hammarö (SE); Jerk Söderman, Karlstad (SE); Robert Lavén, Karlstad (SE); Bengt Wernersson Östberg, Skattkärr (SE)

(73) Assignee: VALMET AB, Sundsvall (SE)

( * ) Notice: Subject to any disclaimer, the term of this patent is extended or adjusted under 35 U.S.C. 154(b) by 416 days.

(21) Appl. No.: 16/615,957

(22) PCT Filed: Apr. 4, 2018

(86) PCT No.: PCT/SE2018/050355
§ 371 (c)(1),
(2) Date: Nov. 22, 2019

(87) PCT Pub. No.: WO2018/217149
PCT Pub. Date: Nov. 29, 2018

(65) Prior Publication Data

US 2020/0141056 A1 May 7, 2020

(30) Foreign Application Priority Data

May 24, 2017 (SE) ..... 1750655-1

(51) Int. Cl.
*D21C 7/06* (2006.01)

(52) U.S. Cl.
CPC ..... *D21C 7/06* (2013.01)

(58) Field of Classification Search
CPC ..... D21C 7/06
See application file for complete search history.

(56) References Cited

U.S. PATENT DOCUMENTS 3,324,534 A 6/1967 Spurk
3,552,780 A 1/1971 Warren
5,164,042 A * 11/1992 Larsen ..... D21C 1/00 162/57

(Continued)

FOREIGN PATENT DOCUMENTS

CN 2345573 Y 10/1999
CN 201964069 U 9/2011

(Continued)

OTHER PUBLICATIONS

Extended European Search Report, Application No. 18806233.5, dated Dec. 11, 2020, 6 pages.

(Continued)

*Primary Examiner* — Anthony Calandra
(74) *Attorney, Agent, or Firm* — Foley & Lardner LLP

(57) ABSTRACT

The invention relates to a chip chute (4; 21; 31; 41) which comprises an elongated, open main body (22; 32; 42) having a rectangular transverse cross-section, and comprises further a transition portion (23; 33; 43), which connects to the elongated, open main body (22; 32; 42) and comprises a circular outlet (26; 36; 46). The invention relates further to a feeding system (1) for transporting comminuted lignocellulosic material from a vessel (2) to a pump (3) located below the vessel (2), wherein such a chip chute (4; 21; 31; 41) is arranged between the vessel (2) and the pum (3).

17 Claims, 5 Drawing Sheets

(56) References Cited

U.S. PATENT DOCUMENTS

| | | | | |
|---|---|---|---|---|
| 5,381,967 | A * | 1/1995 | King | B65G 65/44 222/161 |
| 5,617,975 | A | 4/1997 | Johanson et al. | |
| 5,622,598 | A | 4/1997 | Prough | |
| 5,700,355 | A | 12/1997 | Prough | |
| 5,744,004 | A * | 4/1998 | Ekholm | B01J 3/02 162/241 |
| 5,766,418 | A | 6/1998 | Prough | |
| 6,024,227 | A | 2/2000 | Bilodeau et al. | |
| 6,325,888 | B1 | 12/2001 | Miele et al. | |
| 6,325,890 | B1 | 12/2001 | Prough et al. | |
| 9,611,648 | B1 * | 4/2017 | Fiecke | E04D 13/08 |
| 2001/0025694 | A1 | 10/2001 | Kettunen et al. | |
| 2004/0244932 | A1 * | 12/2004 | Forslund | B65G 65/46 162/236 |
| 2013/0146619 | A1 * | 6/2013 | Ozawa | B65G 65/46 222/236 |
| 2015/0175348 | A1 | 6/2015 | Southwell et al. | |
| 2016/0145797 | A1 | 5/2016 | McCanty | |

FOREIGN PATENT DOCUMENTS

| | | | |
|---|---|---|---|
| EP | 0 344 462 | A1 | 12/1989 |
| EP | 0 344 462 | B1 | 3/1993 |
| JP | 2001-020190 | A | 1/2001 |
| JP | 2001-027380 | A | 1/2001 |
| WO | WO 97/39178 | A1 | 10/1997 |
| WO | WO 2014/112865 | A1 | 7/2014 |

OTHER PUBLICATIONS

Improving Pumping System Performance: A Sourcebook for Industry, Second Edition, US Department of Energy, May 2006, 122 pages.

International-Type Search Report and English translation, Application No. 1750655-1, dated Nov. 28, 2017, 10 pages.

Perry et al., Perry's Chemical Engineer's Handbook, Sixth Edition, 1984, 5 pages.

Japanese Office Action and English translation, Application No. 2019-564994, dated Dec. 24, 2021, 8 pages.

* cited by examiner

SYSTEM AND CHIP CHUTE FOR FEEDING COMMINUTED CELLULOSIC MATERIAL

TECHNICAL FIELD

The present invention relates generally to a system for feeding comminuted cellulosic material from a first vessel to a second vessel, wherein the system comprises a first vessel, a pump and a chip chute disposed between the first vessel and the pump, which chip chute comprises an upper main body with an elongated, hollow shape and a rectangular cross-section with a constant cross-section area or a cross-section area that increases in a downward direction, and a lower and preferably shorter transition portion, which comprises, or transforms into, a circular outlet. The invention relates also to a method for creating a chip chute, wherein a chip chute is arranged by attaching a chip chute according to the invention to a portion (typically a lower end portion) of an existing chip chute.

BACKGROUND

In traditional systems for feeding comminuted cellulosic fibrous materials from, for example, a pretreatment vessel to a digester, the feeding system comprised a low-pressure feeder, typically arranged and disposed below the pretreatment vessel for feeding the comminuted cellulosic fibrous material from the pretreatment vessel to a high-pressure feeder, which transferred the cellulosic material to the digester. In those systems, the high-pressure feeder represented a high-capital cost equipment, which also required significant and regular maintenance.

In the U.S. Pat. No. 6,325,890 to Prough et al., it is disclosed how a high-pressure feeder advantageously can be replaced with one or more pumps located at least thirty feet below the top of a treatment vessel and being configured for pressurizing a slurry of wood chips, which have been steamed in a steaming vessel, to a pressure of at least 10 bar. The slurry is thereby discharged from the steaming vessel to a chip metering device, which, in turn, may be connected to a low-pressure feeder, and therefrom via a conduit to the one or several pumps, whereby it is stated in the patent document that the conduit preferably is a "Chip Tube" sold by the company Ahlstrom Machinery.

To replace a high-pressure feeder with one or several pumps as suggested in the aforementioned patent is favorable from many aspects, and in the pulping industry there is today an ongoing trend to make such a replacement. However, when rebuilding a system for feeding comminuted cellulosic material system from a pretreatment vessel to a treatment vessel, it is typically desired to use existing equipment to the greatest possible extent with as few modifications as possible. In this respect, a chip chute in the shape of a chip tube is not ideal. Further, since the one or more pumps are located a rather long distance (e.g. some thirty feet) below the top of a treatment vessel, the dimensions of the chip chute should be carefully considered, to avoid plugging of the chip chute and also to provide a chip level in the chip chute that does not vary too much.

As indicated above, there is a need for an improved design of a chip chute, which design eliminates, or at least reduces, the risk of plugging of the chip chute and, at the same time, facilitates the maintaining of a steady chip level in the chip chute. The chip chute should also be as compatible as possible with existing equipment, to thereby reduce costs associated with the replacement of a high-pressure feeder with one or several pumps. The chip chute is thereby part of a feeding system for a feeding comminuted fibrous cellulosic material, such as wood chips, from a pretreatment vessel, e.g. a steaming vessel or a chip bin, to a treatment vessel, e.g. a batch digester, a continuous digester, an impregnation vessel or a (pre)hydrolysis vessel, and the invention is also directed to a feeding system comprising a vessel, a pump, and a chip chute located between the vessel and the pump. The invention also discloses a method by which a chip chute is created by attaching a chip chute according to the invention to a portion of an existing chip chute.

SUMMARY OF THE INVENTION

The above-mentioned objects are achieved with a chip chute, a feeding system and a method according to the independent claims. Preferred embodiments are set forth in the dependent claims.

The invention relates to a chip chute, which comprises an elongated, open or hollow main body having a rectangular cross-section, and comprises further a transition portion, which connects to the elongated, open or hollow main body and comprises a circular outlet. The rectangular cross-section, which at least comprises an inner rectangular cross-section, is rectangular when seen in a plane transverse to the general extension of the elongated main body, and can thereby also be referred to as a transverse inner rectangular cross-section. The rectangular cross-section is characterized by a cross-section area, which is constant or increases in at least a portion of the main body as viewed in direction towards the transition portion. By arranging a constant or increasing cross-section area, there is a minimum risk that the chips get stuck or "hang up" in the chip chute.

As was stated above, one object of the present chip chute is to be used in a feeding system where a high-pressure feeder is to be replaced with at least one pump. A special feature of such a high-pressure feeder is that it typically is provided with a rectangular inlet to efficiently fill the elongated, interior pockets of the high-pressure feeder; and for that reason, other equipment or devices, such as a low-pressure feeder, a metering device or an outlet of a vessel, which were directly or indirectly connected to the high-pressure feeder, are often provided with a rectangular inlet or outlet portion. In contrast, a pump, which is going to replace the high-pressure feeder, has typically a circular inlet.

The main body of the present chip chute has a rectangular cross-section and is configured for attachment to an arrangement or a device having a corresponding rectangular connection opening or outlet, while the transition portion with its circular outlet is configured for attachment to the circular inlet of a pump, to thereby make efficient use of existing equipment. As will be understood from the description below, the length of the transition portion (or rather the height of the transition portion since the chip chute is configured for vertical mounting) is largely determined by the diameter of the circular outlet, but is preferably relatively short, which thereby provides for relatively long length (height) of the main body, which, inter alia, provides for a high static pressure at the lower end of the chip chute, which ensures or facilitates proper operation of the pump located therebeneath; and by keeping the rectangular cross-section in the main body, a large cross-sectional area is ensured, and a large volume of cellulosic material can thereby be accommodated in the chip chute, which provides for a steady level in the chip chute, and which also eliminates, or at least reduces, the risk of plugging thereof. To provide for a versatile connection to a pump, the circular outlet can be provided in a short side, a long side or an underside of the transition portion, as will be described below in conjunction with different embodiments of the invention. Further, for all embodiment presented herein, the circular outlet provided in the transition portion can project out a distance from the general shape of the chip chute, to thereby facilitate connection to a pump, or connection to a conduit or pipe leading to a pump. To further ensure that pulp travels smoothly and uninterrupted through the present chip chute and to provide for a large volume inside the main body, the chip chute has preferably a cross-section area that is constant over the length (height) of the main body of the chip chute, or a cross-section area that increases (as seen in a direction towards the transition portion) in at least a portion of the length (height) of the main body of the chip chute.

A chip chute according to the invention can alternatively be accomplished by mounting a chip chute according to the invention to an existing rectangular chip chute or to a portion, such as a lower end portion of an existing rectangular chip chute. In such a case, the chip chute comprises a transition portion comprising a circular outlet, and an upper portion of the chip chute has a rectangular cross-section, which is adapted to attachment to a lower part of an existing rectangular chip chute and whose shape and dimensions are essentially the same as the shape and dimensions of the lower part of the existing rectangular chip chute, but wherein the length (height) of chip chute is modified (i.e. reduced), such that the chip chute and the remaining portion of the original chip chute can be fitted in between a vessel and a pump. The invention relates therefore also to a method for accomplishing a chip chute by attaching a chip chute according to the invention to a portion of an existing chip chute.

Thus, a chip chute according to the invention is characterized in that the chip chute comprises an elongated, open main body having a height and a rectangular transverse cross-section with a cross-section area, and comprises further a transition portion, which connects to the elongated, open main body and comprises a circular outlet, wherein the cross-section area is constant over the height or increases in a direction towards the transition portion in at least a portion of the main body. A method of arranging a chip chute according to the invention comprises the step of attaching upper portion of the chip chute described above to a lower portion of an existing chip chute.

Thus, a feeding system for transporting comminuted lignocellulosic material from a vessel to a pump located below the vessel comprises according to the invention: a chip transfer arrangement arranged in or at a bottom portion of the vessel and comprising a rectangular outlet opening, a circular inlet provided in the pump, and a chip chute arranged between the chip transfer arrangement and the pump, wherein the chip chute comprises an elongated, open main body having a height and a rectangular transverse cross-section with a cross-section area and being connected to the rectangular outlet opening of the chip transfer arrangement, and a transition portion, which comprises a circular outlet, which is connected to the circular inlet of the pump, wherein the cross-section area is constant over the height of the main body or increases in a direction towards the transition portion in at least a portion of the main body.

As used herein, the term "chip transfer arrangement" includes all equipment, devices and arrangements which are arranged between the vessel and the pump and to which the main body of the chip chute connects. Examples of such equipment, devices and arrangements are a metering device, a low-pressure feeder, or simply an outlet provided in a lower portion of the vessel; or a "chip transfer arrangement" can be an existing rectangular chip chute or a portion of a previously arranged rectangular chip chute. Further, it should be understood that a feeding system for feeding comminuted cellulosic materials can be used for feeding of comminuted cellulosic materials that have been diluted with liquid. Such dilution can have taken place before the cellulosic material enters the feeding system of the invention, or the dilution can be done within the feeding system, e.g. in the vessel or in the chip chute. Thus, the term "comminuted cellulosic material" includes comminuted cellulosic material that has been diluted with liquid.

BRIEF DESCRIPTION OF THE DRAWINGS

The present invention will be further explained hereinafter by means of non-limiting examples and with reference to the appended drawings, wherein.

DETAILED DESCRIPTION OF PREFERRED EMBODIMENTS

The present invention relates generally to a system for feeding comminuted cellulosic fibrous material from a first vessel to a second vessel by means of at least one pump. The comminuted cellulosic fibrous material is typically wood chips, which can have been diluted with liquid, e.g. water, or which are diluted with liquid, e.g. water, in the feeding system itself, e.g. in the first vessel or in a chip chute, which is part of the system, but the system can be applied also for other types of cellulosic materials. The first vessel can be a vessel for pretreatment of the wood chips (or other cellulosic materials), such as a steaming vessel or a chip bin, while the second vessel can be a continuous digester, a batch digester, an impregnation vessel or a hydrolysis or prehydrolysis vessel, but also other types of vessels with other purposes are conceivable. (The second vessel is, however, not part of a system according to the invention.) In such a system, at least one pump is arranged below the first vessel, and the comminuted cellulosic material is transported from the first vessel to the pump via a chip chute, which can be connected directly to an outlet provided in or at a lower portion of the first vessel. In some cases, there is, however, a need for arranging other devices between the first vessel and the pump. Examples of such devices are a metering device, which measures the material or media flow from the first vessel, a low-pressure feeder or a screw feeder, which effectuates or facilitates feeding of cellulosic material from the first vessel. Another example of such a device is a portion of an existing chip chute which has previously been used in connection with, for example, a high-pressure feeder. As stated above, herein, all such devices or arrangements, including an outlet from the first vessel or another chip chute arranged below said first vessel, can be referred to as a "chip transfer arrangement".

Figure 1:
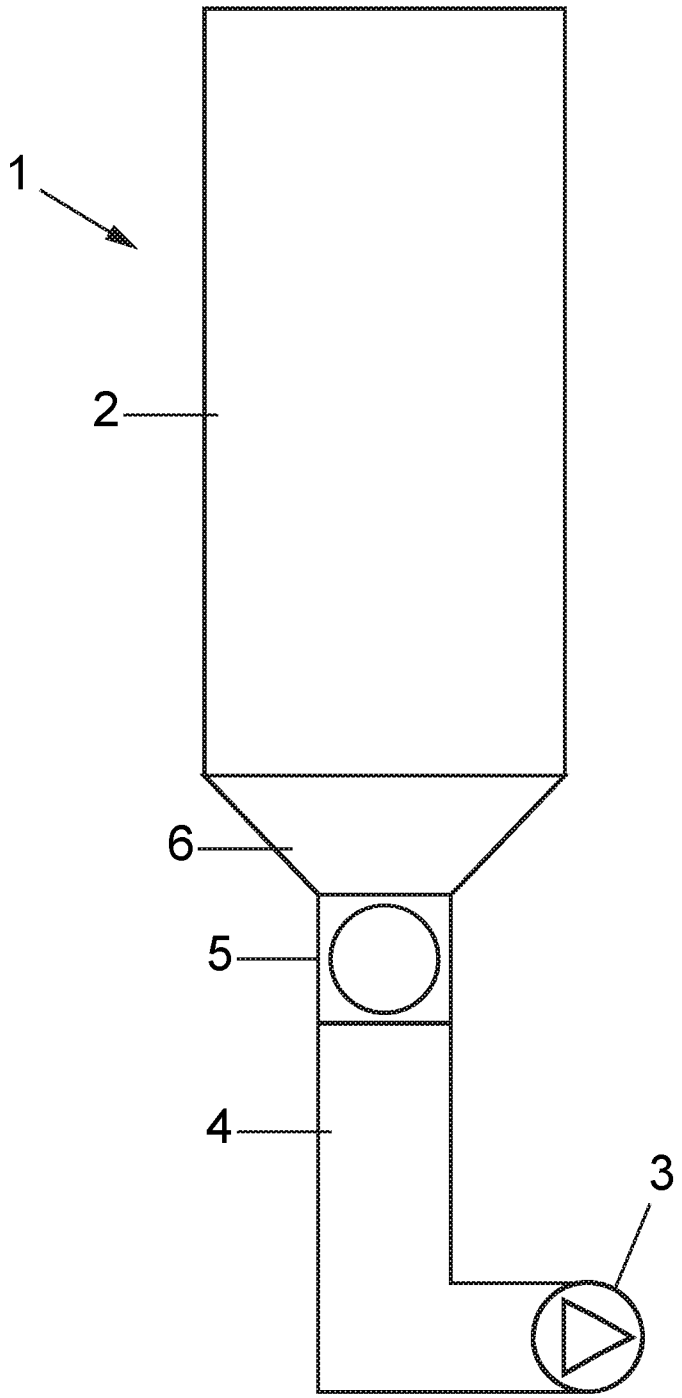
FIG. 1 is a schematic illustration of a system for feeding comminuted cellulosic material according to the present invention.

A system 1 for feeding comminuted cellulosic materials in accordance with the present invention is very schematically illustrated in FIG. 1. The feeding system 1 comprises a vessel 2, a pump 3 located below the vessel 2, and a chip chute 4 arranged between the vessel 2 and the pump 3. In use, the vessel 2 contains comminuted cellulosic material, such as wood chips, which can have been diluted with liquid or which can be diluted with liquid in, for example, the chip chute 4, and the vessel 2 is typically configured for some sort of treatment, e.g. steaming, of the comminuted cellulosic material. The vessel 2 can, however, also merely be configured for (temporary) storage of the cellulosic material without any special treatment taking place therein. Further, the chip chute 4 is connected to a chip transfer arrangement 5, which in the system 1 shown in FIG. 1 comprises a metering device, but which—as stated above—can be a feeding device, such as a low-pressure feeder or a screw feeder, or simply an outlet arranged in a bottom portion 6 of the vessel 2.

When the system 1 is in operation, an outlet (not shown in the figure) of the pump 3 is via at least one conduit connected to a treatment vessel, such as a digester or an impregnation or (pre)hydrolysis vessel; or the pump 3 is connected to another pump, which, in turn, is connected to the treatment vessel (or to yet another pump). Such a treatment vessel, i.e. a vessel downstream of pump 3, is, however, not part of the present invention, and is therefore not illustrated in FIG. 1.

Figure 2:
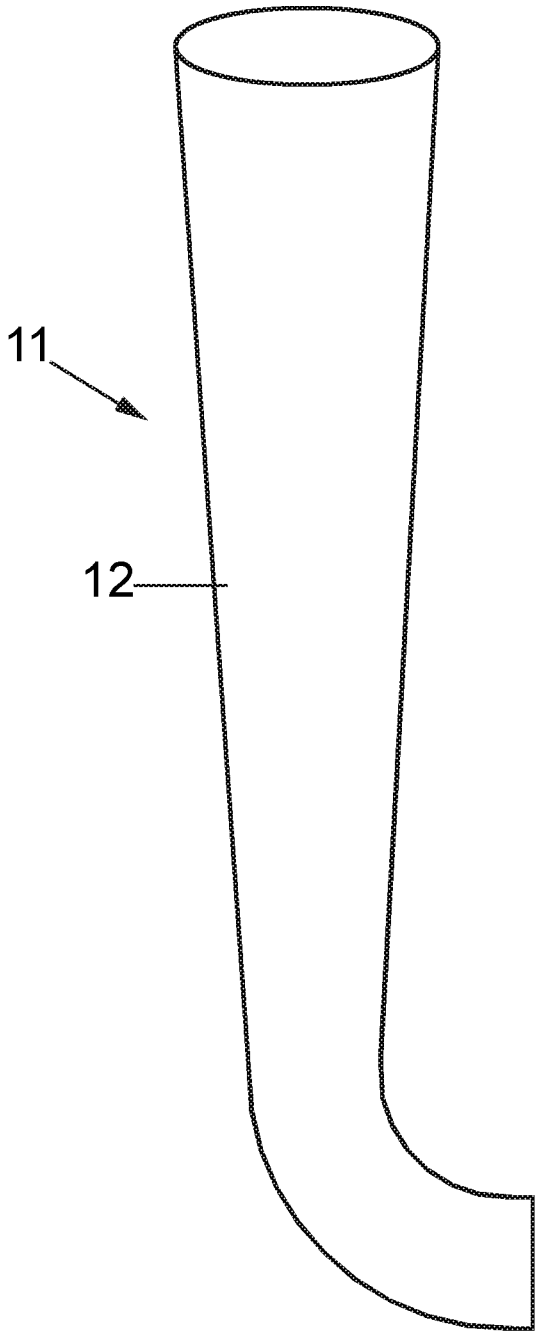
Fig.2 (Prior Art)
FIG. 2 is a schematic illustration of a chip chute according to the prior art.

For better understanding of the context in which the present invention is used, a chip chute 11 according to the prior art is schematically illustrated in FIG. 2, wherein the chip chute 11 comprises an elongated tubular body 12. The chip chute 11 has a first, upper circular cross-section and tapers downwards to a second, lower and smaller circular cross-section, to thereby provide the chip chute 11 with a long, relatively narrow conical shape. As said above, the lower end of the chip chute 11 is intended for connection to a pump, and the diameter of the lower circular cross-section is thereby typically given by the inlet dimension of this pump. Because of the circular upper cross-section of the elongated tubular body 12, the chip chute 11 cannot be directly connected to a chip transfer arrangement having an outlet with a rectangular cross-section; and the long, narrow shape of the elongated tubular body 12 makes it further difficult to maintain a steady chip and liquid level in the chip chute 11, since the elongated tubular body 12 thereby can only accommodate a relatively small volume of cellulosic material and liquid.

Figure 3:
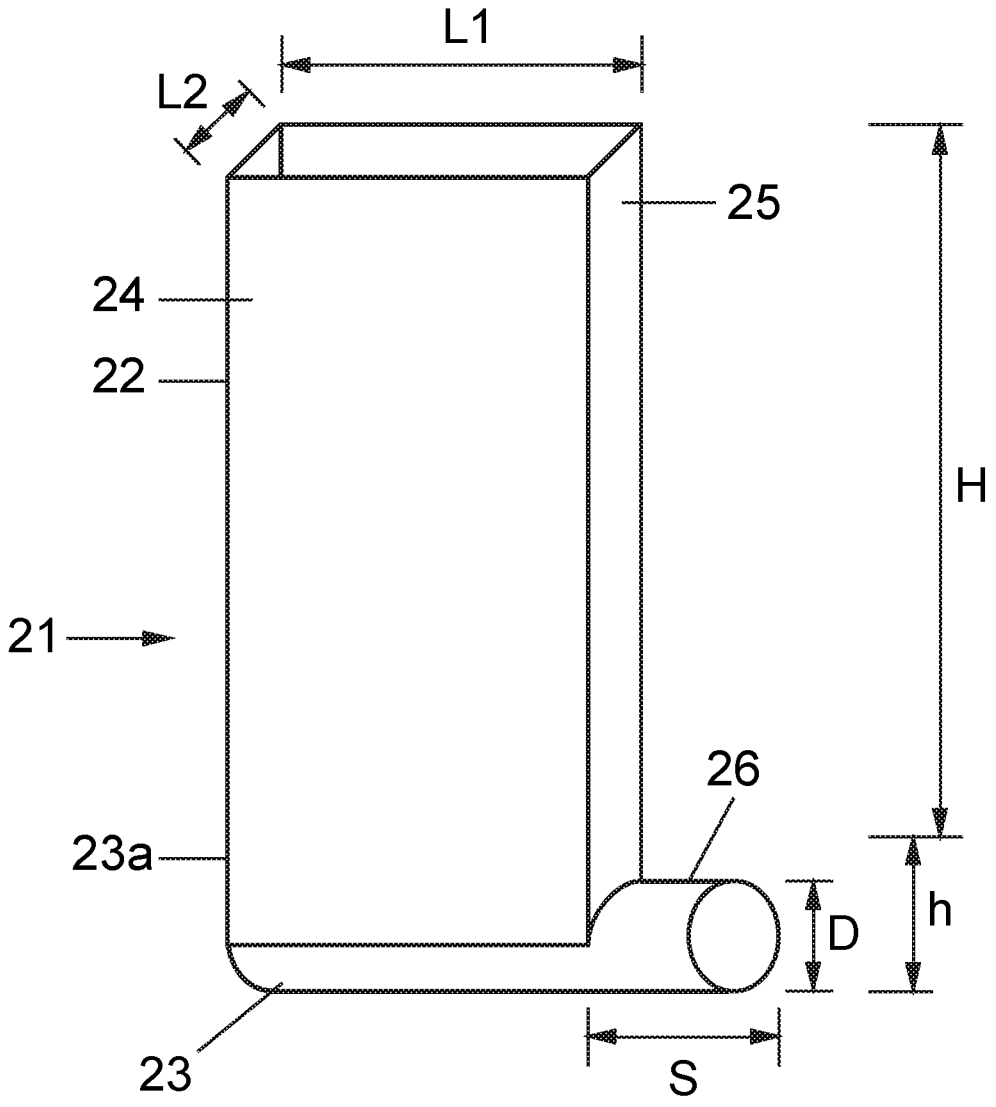
FIG. 3 is a schematic illustration of a first embodiment of a chip chute according to the present invention.

A first embodiment of a chip chute 21 according to the present invention is schematically illustrated in FIG. 3, wherein the chip chute 21 comprises an upper main body 22 and a lower transition portion 23. The main body 22 has an elongated shape with a rectangular cross-section as viewed in a plane transverse to the general extension of the elongated main body 22. Hence, the rectangular cross-section can be referred to as a transverse rectangular cross-section. Further, since it is the inner dimensions of the main body 22 that are important for the transport of comminuted cellulosic material, it is at least the inner cross-section of the main body 22 that is rectangular, although also the outer cross-section can be (and typically is) rectangular, as illustrated in FIG. 3. The remarks about inner, outer and transverse rectangular cross-sections apply to all embodiments described and disclosed herein. The rectangular cross-section of the main body 22 is a uniform or non-uniform rectangular cross-section, i.e. the main body 22 has a transverse rectangular cross-section along its entire height, irrespectively where such rectangular cross-section is viewed, as will be described below. Further, the area of the rectangular cross-section is constant over the entire length (height) of the main body, or the rectangular cross-section area increases towards the transition portion 23 in at least a portion of the main body 22. In the latter case, the main body 22 can in particular be arranged such that main body 22, or at least a portion thereof, widens downwards, i.e. the area of the cross-section is larger at a lower part of the main body 22 than at a more upper part of the main body 22. Such a widening shape prevents, or at least minimizes the risk, that pulp gets stuck in the chip chute 21. When the rectangular cross-section area increases towards the transition portion 23 in at least a portion of the main body 22, this feature means that the rectangular cross-section area can increase, e.g. gradually, along the entire length (height) of the main body, or the rectangular cross-section area can increase, e.g. gradually, in one portion (or can increase in several portions) while the cross-section area is constant in one other portion (or in several other portions). Thus, as an example only, if a first uppermost portion of a main body has a constant cross-section area, an intermediate and adjoining portion can have cross-section area that increases in downward direction, and a lowest portion, which adjoins to the intermediate portion, can have a constant cross-section area, where the cross-section area of the lowest portion differs from the cross-section area of the uppermost portion, i.e. the cross-section area of the lowest portion is larger than the cross-section area of the uppermost portion. The above definition of a cross-section area that increases in at least a portion of a main body in downward direction towards a transition portion applies to all embodiments disclosed and described herein. A supplementary feature, which applies to all embodiments of a chip chute according to the invention, is that the cross-section area does not decrease, or at least does not decrease substantially in any portion of the main body, where the term "substantially" implies that if the cross-section area does decrease it is only insignificantly in a very small portion of the main body, e.g. in a joining portion where to portion has been joined together by, e.g., a welding seam or in an overlap joint.

Further, as shown in FIG. 3, the rectangular cross-section of the main body 22 is created by a first or long side 24 having a length L1 and a second or short side 25 having a length L2, where L1, for example, can be in the interval from 600 mm to 2500 mm and L2 can be interval from 200 mm to 800 mm, with L2≤L1. In practice, the dimensions of L1 and L2 are adapted to the dimensions of a chip transfer arrangement, to which the upper main body 22 is going to be attached or connected when in operation. A uniform rectangular cross-section is thereby characterized by the ratio L2/L1 being constant over a portion of the main body 22, while a non-uniform cross-section is characterized by the ratio L2/L1 being non-constant. As an example, for a non-uniform cross-section, an upper part of the main body 22 can be markedly rectangular with L1 much larger than L2, whereas a lower part of the main body can be almost quadratic with L1 only slightly larger than L2. The discussion about uniform and non-uniform cross-sections applies to all embodiments of a chip chute according to the present invention as presented herein. In all cases, the cross-section area of the main body 22 is constant over the length (height) of the main body 22, or the cross-section area increases towards the transition portion 23 in at least a portion of the main body 22. To create a large volume for the comminuted cellulosic material that is going to be transferred by the chip chute 21 and to make full use of the cross-sectional area created by the long side 24 and the short side 25, the main body 22 is preferably relatively long (or rather high since the chip chute 21 is configured for vertical mounting), to thereby create a large volume for the comminuted cellulosic material to be transported in and transferred by the chip chute 21, and to also create a relatively high static pressure at the lower end of the chip chute 21. The former ensures that the chip level does not vary too much in the chip chute 21, while the latter promotes efficient pumping in a pump arranged below the chip chute 21. In FIG. 3, the height of the main body 22 (which also can be referred to as a first height) is indicated by the reference letter H, while the height of the transition portion 23 (which also can be referred to as a second height) is indicated by the reference letter h. The height h of the transition portion 23 is preferably less than 50% of the height H of the main body 22, and more preferably less than 30% of the height H of the main body 22, and even more preferably less than 20% of the height H of the main body 22, and most preferably less 10% of the height H of the main body 22. Thus, by providing a main body 22 having a height H, which is long in relation to the height h of an adjoining transition portion 23, and having a rectangular cross-section with constant or increasing cross-section area, a maximum volume is created for the comminuted cellulosic material to be transported in the chip chute 21, with a reduced risk that the cellulosic material gets stuck in the chip chute 21. As stated above, in preferred embodiments, the cross-section area is constant over the height H of the main body 22, or the cross-section area is larger in a lower part of the main body 22 than in an upper part of the main body 22, i.e. the main body 22, or at least a portion thereof, widens in a downward direction, as was explained above.

Figure 4:
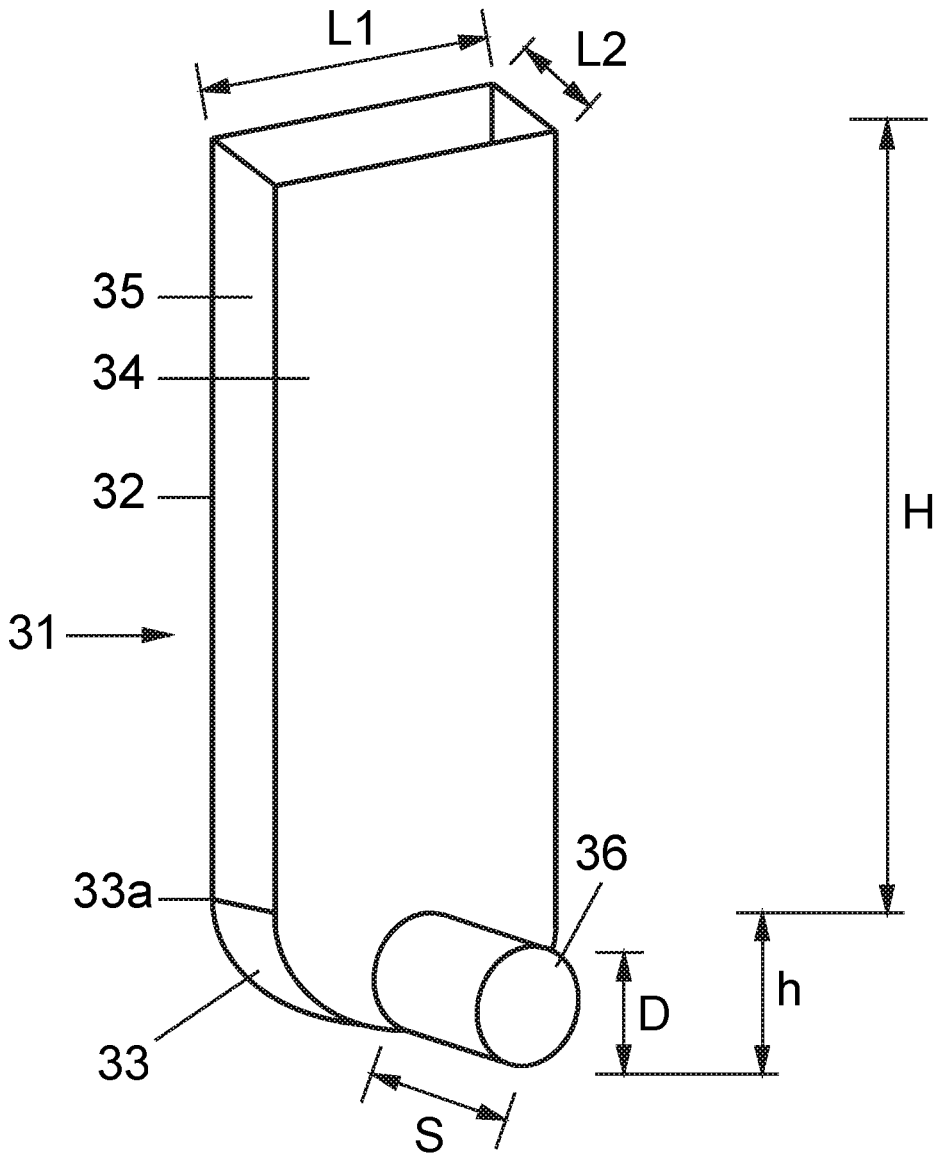
FIG. 4 is a schematic illustration of a second embodiment of a chip chute according to the present invention.
Figure 5:
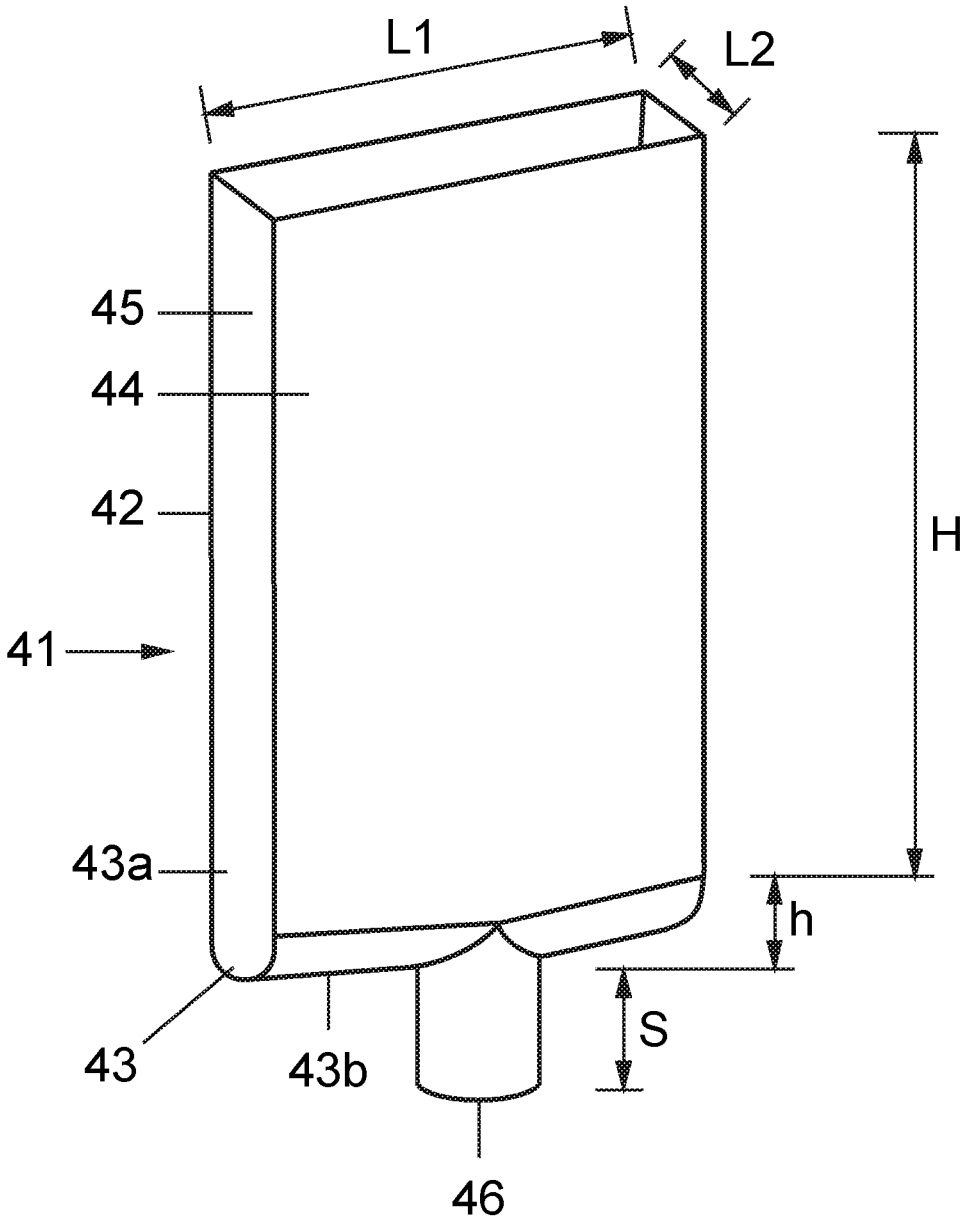
FIG. 5 is a schematic illustration of a third embodiment of a chip chute according to the present invention.

The transition portion 23 comprises further a circular outlet 26 having a diameter D, which typically is adapted to the inlet diameter of a pump, to which the circular outlet 26 is configured for attachment or connection. The diameter D is typically in the interval from 200 mm to 800 mm. Further, as indicated above, the transition portion 23 is preferably made relatively short, and the height h of the transition portion 23 can be such that $D \leq h \leq 4D$. As should have been appreciated, the chip chute 21 is intended to be arranged between a vessel and a chip pump, and by keeping the height h of the transition portion 23 short, i.e. between D and 4D, a relatively large space is provided for the upper main body 22, which can have a height H that is preferably at least 1000 mm. To facilitate the connection to the inlet of a pump, the circular outlet 26 can protrude or project a distance S out from the general shape of the transition portion 23. Thus, in the first embodiment illustrated in FIG. 3, the circular outlet 26 protrudes a distance S from the short side 25. It should, however, be appreciated that it is not mandatory that the circular outlet 26 protrudes a distance from the transition portion, and the distance S can therefore be such that $S \geq 0$. It can also be noted that the length S of the circular outlet 26 is not crucial, since the outlet 26 usually is connected to a conduit or pipe, which in turn is connected to a pump. It can further be appreciated that in this first embodiment, the transition portion 23 is mainly provided as a lower half of a tube, an outer end of which forms the circular outlet 26, and that the main body 22 continuously transforms into an upper portion 23*a* of the transition portion 23, but it should be appreciated that other, more none-continuous transitions from a main body to a transition portion are within the scope of the invention. As used herein, the term "continuously transforms" means that the transformation of the main body 22 into the upper portion 23*a* of the transition portion 23 is made in a smooth and gradual way without sudden and/or irregular shape transformations. However, in all cases, the upper portion 23*a* of the transition portion 23 has essentially the same dimensions, L1 and L2, as the main body 22. Here, it should be noted that the main body 22 has a rectangular cross-section over its height H, but the area of this cross-section does not have to be constant over the whole height H, i.e. the lengths L1 and L2 can vary over the height H. By providing a chip chute with a cross-sectional area that varies over the height of the chip chute, the risk of plugging can be reduced, and for that reason chip chutes are sometimes provided with a shape that widens in a downward direction, as was explained above. In the embodiments of a chip chute according to the present invention that are depicted in FIG. 3 to FIG. 5, the lengths L1 and L2 of a long side and a short side, respectively, are for illustrative reasons indicated at an upper end of the main body of a chip chute. It should, however, be understood that these lengths L1 and L2 can vary over the height H of the main body, and that the lengths L1 and L2 can be measured at the lower end of a main body, or alternatively are measured at an upper end of a transition portion which connects to the main body. The remarks about the lengths L1 and L2 apply to all embodiments disclosed and described herein.

In FIG. 4, a second embodiment of a chip chute 31 is schematically illustrated. As in the embodiment described above in conjunction with FIG. 3, the chip chute 31 comprises an upper main body 32 and a lower transition portion 33, which, in turn, comprises a circular outlet 36. The main body 32 has a rectangular cross-section (as seen in a plane transverse to the extension of the main body 32), and has in particular at least a rectangular inner cross-section, which is created by a first or long side 34 having a length L1 and a second or short side 35 having a length L2, where L1, for example, can be in the interval from 600 mm to 2500 mm and L2 can be interval from 200 mm to 800 mm, with $L2 \leq L1$. The cross-section area of the rectangular cross-section is constant over the length (height) of the main body 32, or is increasing in a downward direction, i.e. towards the transition portion 33, in at least one portion of the main body 32. Thus, by providing a main body 32 having a height H, which is long in relation to the height h of an adjoining transition portion 33, and having a rectangular cross-section with constant or increasing cross-section area, a maximum volume is created for the comminuted cellulosic material to be transported in the chip chute 31, with a reduced risk that the cellulosic material gets stuck in the chip chute 31. Also in this embodiment, the circular outlet 36 can project a distance S out from the general shape of the transition portion 33, such that $S \geq 0$, but in this embodiment, the circular outlet 36 is arranged in the long side 34. Also in this embodiment, the main body 32 continuously transforms into an upper portion 33*a* of the transition portion 33, which in a downward direction transforms into a lower part of a semi-cylinder, but also other shapes of both the transition portion as well as the transition from the main body to the transition portion are within the scope of the invention. Again, as used herein, the term "continuously transforms" means that the transformation of the main body 32 into the upper portion 33*a* of the transition portion 33 is made in a smooth and gradual way without any irregular or sudden shape changes or transformations. However, in all cases, the upper portion 33*a* of the transition portion 33 has essentially the same dimensions, L1 and L2, as the main body 32. Further, in FIG. 4, the height of the main body 32 (which is also referred to as a first height) is indicated by the reference letter H, while the height of the transition portion 33 (which is also referred to as a second height) is indicated by the reference letter h. In a preferred embodiment of the invention, the first height H of the main body 32 can be at least 1000 mm, while the second height h of the transition portion 33 is mainly determined by the diameter D of the outlet portion 36 such that D≤h≤4D, where 200 mm≤D≤800 mm. The height h of the transition portion 33 is preferably less than 50% of the height H of the main body 32, and more preferably less than 30% of the height H of the main body 32, and even more preferably less than 20% of the height H of the main body 32, and most preferably less 10% of the height H of the main body 32.

In FIG. 5, a third embodiment of a chip chute 41 according to the invention is schematically illustrated. As in the embodiments described above in conjunction with FIG. 3 and FIG. 4, respectively, the chip chute 41 comprises an upper main body 42 and a lower transition portion 43, which, in turn, comprises a circular outlet 46. The main body 42 has a rectangular cross-section (as seen in a plane transverse to the extension of the main body 42), and in particular at least a rectangular inner cross-section, which is created by a first or long side 44 having a length L1 and a second or short side 45 having a length L2, where L1, for example, can be in the interval from 600 mm to 2500 mm and L2 can be interval from 200 mm to 800 mm, with L2≤L1. The cross-section area of the rectangular cross-section is constant over the height of the main body 42, or is increasing in a downward direction, i.e. towards the transition portion 43, in at least one portion of the main body 42. Thus, by providing a main body 42 having a height H, which is long in relation to the height h of an adjoining transition portion 43, and having a rectangular cross-section with constant or increasing cross-section area, a maximum volume is created for the comminuted cellulosic material to be transported in the chip chute 41, with a reduced risk that the cellulosic material gets stuck in the chip chute 41. Also in this embodiment, the circular outlet 46 can project a distance S from the general shape of the transition portion 43, such that S≥0 mm, but in this embodiment, the circular outlet 46 is arranged in an underside 43*b* of the transition portion 43. Also in this embodiment, the main body 42 continuously transforms into an upper portion 43*a* of the transition portion 43, which in a downward direction transforms into the rounded underside 43*b*, but also other shapes of both the transition portion as well as the transition from the main body to the transition portion are within the scope of the invention. Also here, the term "continuously transforms" means that the transformation of the main body 42 into the upper portion 43*a* of the transition portion 43 is made in a smooth and gradual way. However, in all cases, the upper portion 43*a* of the transition portion 43 has essentially the same dimensions, L1 and L2, as the main body 42. Further, in FIG. 5, the height of the main body 42 (which also can be referred to as a first height) is indicated by the reference letter H, while the height of the transition portion 43 (which also can be referred to as a second height) is indicated by the reference letter h. In a preferred embodiment of the invention, the first height H of the main body 42 is at least 1000 mm, while the second height h of the transition portion 43 is mainly determined by the diameter D of the outlet portion 46 such that D≤h≤4D, where 200 mm≤D≤800 mm. The height h of the transition portion 43 is preferably less than 50% of the height H of the main body 42, and more preferably less than 30% of the height H of the main body 42, and even more preferably less than 20% of the height H of the main body 42, and most preferably less 10% of the height H of the main body 42.

In the embodiments illustrated in conjunction with FIG. 3 to FIG. 5, a chip chute has been described as a single unit comprising essentially a main body having a rectangular cross-section and a transition portion comprising a circular outlet. It is, however, possible and within the scope of the invention to provide a chip chute with these features by connecting an upper end of the chip chute to a lower end of an existing portion of another, typically previously arranged chip chute, which typically was arranged and designed for connection to a high-pressure feeder.

Although the present invention has been described with reference to specific embodiments, also shown in the appended drawings, it will be apparent to those skilled in the art that many variations and modifications can be done within the scope of the invention as described in the specification and defined with reference to the claims below.

The invention claimed is:

1. A feeding system for transporting comminuted lignocellulosic material to a pump having a circular inlet, said feeding system comprising:

a vessel;

a chip transfer arrangement arranged in, or at a bottom portion of, the vessel, the chip transfer arrangement comprising a rectangular outlet opening;

a chip chute arranged between the chip transfer arrangement and the pump, wherein the chip chute comprises:

first, second, third, and fourth planar lateral walls defining an open area having a rectangular cross-section, with an inlet opening located at the outlet opening of the chip transfer arrangement, wherein the first and second planar lateral walls oppose each other and extend in a height (H) direction and a first length (L1) direction, and wherein the third and fourth planar lateral walls oppose each other and extend in the height (H) direction and a second length (L2) direction perpendicular to the first length (L1) direction, a curved bottom wall that is located at a bottom of the planar lateral walls and curves from the first planar lateral wall to the second planar lateral wall, and a cylindrical outlet tube protruding laterally from one of the planar lateral walls and configured to be connected to the circular inlet of the pump.

2. The feeding system according to claim 1, wherein the chip transfer arrangement comprises an outlet from the vessel.

3. The feeding system according to claim 1, wherein the chip transfer arrangement comprises a metering device, a chip feeding device or a screw feeder.

4. The feeding system according to claim 1, wherein a cross-sectional area of the rectangular cross-section increases in a direction towards the curved bottom wall in at least a portion of the chip chute.

5. The feeding system according to claim 1, wherein the cylindrical outlet tube protrudes in the first length (L1) direction from the third planar lateral wall.

6. The feeding system according to claim 5, wherein a diameter (D) of the cylindrical outlet tube is no greater than the same as a length (L2) of the third planar lateral wall.

7. The feeding system according to claim 6, wherein a lower portion of the cylindrical outlet tube is continuous with the curved bottom wall.

8. The feeding system according to claim 5, wherein a first length (L1) of the first planar lateral wall and the second planar lateral wall is greater than a second length (L2) of the third planar lateral wall and the fourth planar lateral wall.

9. The feeding system according to claim 1, the cylindrical outlet tube protrudes in the second length (L2) direction from the first planar lateral wall.

10. The feeding system according to claim 9, wherein a diameter (D) of the cylindrical outlet tube is no greater less than a length (L1) of the first planar lateral wall.

11. The feeding system according to claim 9, wherein a first length (L1) of the first planar lateral wall and the second planar lateral wall is greater than a second length (L2) of the third planar lateral wall and the fourth planar lateral wall.

12. The feeding system according to claim 1, wherein a first length (L1) of the first planar lateral wall and the second planar lateral wall is greater than a second length (L2) of the third planar lateral wall and the fourth planar lateral wall.

13. A feeding system for transporting comminuted lignocellulosic material to a pump having a circular inlet, said feeding system comprising:

a vessel;

a chip transfer arrangement arranged in, or at a bottom portion of, the vessel, the chip transfer arrangement comprising a rectangular outlet opening;

a chip chute arranged between the chip transfer arrangement and the pump, wherein the chip chute comprises:

first, second, third, and fourth planar lateral walls defining an open area having a rectangular cross-section, with an inlet opening located at the outlet opening of the chip transfer arrangement, wherein the first and second planar lateral walls oppose each other and extend in a height (H) direction and a first length (L1) direction, and wherein the third and fourth planar lateral walls oppose each other and extend in the height (H) direction and a second length (L2) direction perpendicular to the first length (L1) direction, a curved bottom wall that is located at a bottom of the planar lateral walls and curves from the first planar lateral wall to the second planar lateral wall, and a cylindrical outlet tube protruding downward from the curved bottom wall and configured to be connected to the circular inlet of the pump.

14. The feeding system according to claim 13, wherein the chip transfer arrangement comprises an outlet from the vessel.

15. The feeding system according to claim 13, wherein the chip transfer arrangement comprises a metering device, a chip feeding device or a screw feeder.

16. The feeding system according to claim 13, wherein a cross-sectional area of the rectangular cross-section increases in a direction towards the curved bottom wall in at least a portion of the chip chute.

17. The feeding system according to claim 13, wherein a first length (L1) of the first planar lateral wall and the second planar lateral wall is greater than a second length (L2) of the third planar lateral wall and the fourth planar lateral wall.

* * * * *